US006892457B2

(12) United States Patent
Shiba et al.

(10) Patent No.: US 6,892,457 B2
(45) Date of Patent: May 17, 2005

(54) ELECTRIC SHAVER FLOATING HEAD SUPPORT STRUCTURE

(75) Inventors: Takeshi Shiba, Hikone (JP); Fumio Taniguchi, Hikone (JP); Masanobu Yamasaki, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/461,679

(22) Filed: Jun. 16, 2003

(65) Prior Publication Data

US 2004/0010919 A1 Jan. 22, 2004

(30) Foreign Application Priority Data

Jun. 17, 2002 (JP) ..... 2002-176471
Oct. 30, 2002 (JP) ..... 2002-316160

(51) Int. Cl.[7] ..... B26B 19/04
(52) U.S. Cl. ..... 30/43.92; 30/527
(58) Field of Search ..... 30/43.92, 42, 44, 30/45, 527

(56) References Cited

U.S. PATENT DOCUMENTS 6,301,786 B1 10/2001 Oswald et al.
2002/0020066 A1 * 2/2002 Eichhorn et al. ..... 30/43.92
2002/0108251 A1 8/2002 Brum et al.

FOREIGN PATENT DOCUMENTS

| | | |
|---|---|---|
| GB | 2266070 | 10/1993 |
| JP | 6-343776 | 12/1994 |
| JP | 10-43443 | 2/1998 |
| WO | 00/38891 | 7/2000 |
| WO | 03026854 | 4/2003 |
| WO | 03041918 | 5/2003 |

OTHER PUBLICATIONS

English Language Abstract of JP 6–343776.
English Language Abstract of JP 10–43443.

* cited by examiner

*Primary Examiner*—Charles Goodman
(74) *Attorney, Agent, or Firm*—Greenblum & Bernstein, P.L.C.

(57) ABSTRACT

A water and dust-proof electric shaver head support structure that provides a wide range of movement to the floating shaver head to closely follow the contours of the skin. The floating shaver head, which contains the motor and shaving blades, freely pivots in the lateral plane and telescopically floats in relation to the shaver grip. A box-like space is formed in the shaver grip below the lower surface of the shaver head, and front and rear support walls extend upward from the shaver grip to support the shaver head in the forward/rearward direction.

19 Claims, 9 Drawing Sheets

ELECTRIC SHAVER FLOATING HEAD SUPPORT STRUCTURE

BACKGROUND OF THE INVENTION

1. Field of the Invention

The present invention relates to a floating head support structure for an electric shaver in which the free articulated movement of the head portion in relation to the grip portion maintains improved contact between the shaving blades and the skin.

2. Description of Related Art

A conventional electric shaver of the type addressed by the invention incorporates a grip portion, a laterally pivotable head structured as a separate component from the grip portion, and a motor housed within the grip portion which is located beneath the head portion. This structure poses a problem in that it largely restricts the lateral swinging movement of the head portion, and thus limits the ability of the head portion to follow the contours of the skin.

Various types of conventional electric shavers are structured to allow movement of the head in relation to the grip as a means of better maintaining the cutting blades in contact with the skin during shaving. A typical example of this type of electric shaver places the motor in the head, and supports the pivoting movement of the head through front and rear walls built into the grip. This type of shaver is noted in Japanese Kokai Patent Publication No. H06-343776.

As noted by Japanese Kokai Patent Publication No. H06-343776, the motor and head are structured as a single unit which is supported by a front and rear wall, which are built into the grip, as a means of allowing the head to pivot in the lateral direction. The upper surface of the grip case must thus be constructed as an open structure that allows the motor to be housed therein, and further necessitates that the lower surface of the head be formed to the same radius as the open part of the grip case as a means of covering the grip case. This structure allows the head to move only on the radial surface provided, thus limiting the range of movement of the head in relation to the grip, and thus preventing the head from moving in a way that could more accurately follow the contours of the skin being shaved. Furthermore, the grip case must be made to a relatively large width, that is, a width greater than that of the head, to allow sufficient space for the movement of the motor which must laterally swing with the head, thus necessitating a grip that is difficult to size for a comfortable fit to the hand.

Another example of a conventional electric shaver of the type relating to the invention is one in which the motor and head are incorporated as a single structure capable of a laterally rotating and telescoping movement against the skin. Accordingly, this type of electric shaver incorporates a head support structure that allows both a lateral pivoting and telescopic movement of the head as noted in Japanese Kokai Patent Publication No. H10-43443.

As the electric shaver noted in Japanese Kokai Patent Publication No. H10-43443 also describes a structure in which the motor part of the integrated head/motor unit extends into the grip, the head is still not able to pivot to an adequate angle in the lateral direction due to the motor contacting the limiting inner surfaces of the grip case.

Moreover, a rotational support structure has been put forth in WO 00/38891, for example, for an electric shaver head that contains both the shaving blades and motor within the head case, and that supports the fore-aft pivoting movement of the head on a shaft located near the top of the head. In this structure, the pivoting movement of the head results in the lower part of the head potentially swinging to a point that exceeds the boundary of the grip. The head must thus be made to relatively small dimensions to prevent the lower part from coming into contact with the user's fingers holding the grip, thus necessitating that a correspondingly small motor be employed with the result that the electric shaver provides relatively weak shaving power. A structure could be considered in which the location of the shaft on which the head rotates is lowered, but this could result, depending on the attitude of the shaver when held by the user, in the head freely rotating when separated from the skin, and thereby preventing the shaver from providing an adequate level of performance.

SUMMARY OF THE INVENTION

The present invention, having taken the aforesaid shortcomings into consideration, offers an electric shaver floating head support structure through which the floating head is supported through a wide range of movement in order to accurately follow the contours of the skin, regardless of the attitude of the electric shaver, and which also prevents the invasion of debris and water into the electric shaver.

The present invention includes an electric shaver comprised of a head portion which incorporates a motor and shaving blades, and a grip portion that supports the free floating movement of the head portion. A box-like space (hereinafter referred to as a space) is formed within the grip portion beneath the lower surface of the head portion, and front and rear support walls extend upward beyond the space to sandwich the lower portion of the head portion at the forward and rearward facing sides. This structure firmly supports the head portion against pressure applied thereto in the fore-aft direction, thus allowing the user to hold the electric shaver by pressing against front and rear support walls with the thumb and fingers without the fingers entering the region in which head portion moves. This structure is able to provide a wide range of movement that allows the head portion to easily follow the contours of the skin being shaved, and thus improves the electric shaver's performance. The invasion of water and debris into the electric shaver is prevented through the head portion and the space of the grip being independently structured components.

It is preferable that spring articulation elements be installed between the head portion and the upper surface of the space in the grip. The spring articulation elements have no effect on the size of the grip, and thus allow the grip to be formed to a narrow contour that can be comfortably held in the hand. The spring articulation elements also provide for a more stable floating movement of the head.

It is preferable that the spring articulation elements support the vertical movement of head support brackets, which are pivotably joined to the head portion, within the guide slots formed on the inner surfaces of front and rear support walls, and that the spring articulation elements energize springs that press upward against the head support brackets. The spring articulation elements thus provide for a smooth pivoting and vertically floating movement of the head.

It is preferable that the head support brackets be attached to the head portion at multiple points along the width direction, thus forming a mechanism whereby the head support bracket at the end of the head not in contact with the skin becomes a pivot point that allows the head to widely incline in the lateral direction.

It is preferable that flexible elastomer pieces be placed in the upper end of the guide slots that guide the movement of the head support brackets. Elastomer pieces absorb the shock of the support brackets returning to the upper travel limit of the guide slots, insulate the user's hand from the shock, and reduce noise.

It is preferable that the grip portion consists of front and rear housings that define the space therebetween, and that front and rear support walls extend upward from the housings, thereby creating a structure in which the head support structure and space in the grip portion are formed simultaneously. The electric shaver thus becomes easier to assemble, a rigid support structure is formed for the head by front and rear walls, shaving performance is improved, and the number of shaver components is reduced.

It is preferable that a head case extension extend downward from the central region of the lower surface thereon to form an axis of support for the head portion. Both ends of the lower surface of the head case extension rise upward to form indentations that allow head portion to widely incline in the lateral direction to better follow the contours of the skin.

It is preferable that the head case extension be located between and covered by front and rear support walls in the fore-aft direction, thus providing a firmly supported pivoting movement for the head portion and a structure resistant to the accumulation of hair.

It is preferable that the width L1 of the front and rear support walls be narrower than the width of the grip portion L2 in the lateral direction F, thus forming a structure that largely prevents the user's fingers from entering the region in which the head portion moves, that inhibits the user's fingers from contacting and interfering with the movement of the head portion, and that increases the security of the user's grip on the electric shaver.

It is preferable that a structure be provided to prevent free play of the head portion the fore-aft direction E, regardless of any inclination of the space defined by the front and rear support walls, through a mechanism that supports the head portion at either the front or rear support wall.

It is preferable that a finger portion extend from the lower rear surface of the head portion and slide against either the front or rear support wall as a means of preventing the inclination of the head portion in the fore-aft direction E. This mechanism prevents a reduction in shaving performance that can result from the head portion inclining in reaction to pressure applied thereto in the fore-aft direction E when shaving.

It is preferable that a waterproof structure be formed between the head portion and the space in the grip portion, that an elastic tube connects the head portion and the grip portion, and that wires run through the elastic tube to provide electrical power to the head portion from the grip portion. This structure thus provides for a wide range of movement between the head portion and the grip portion, maintains a waterproof electrical connection therebetween, and allows the electric shaver to be easily cleaned.

It is preferable that a non-slip elastomer part be installed on at least the front surface of the grip portion, thereby affording the user a more secure grip on the electric shaver when the user's thumb is normally placed on the elastomer part with fingers gripping the grip portion, and thus increasing the security with which the shaver can be held. As a result, the electric shaver can be gripped more securely and is largely prevented from slipping out of the hand.

An aspect of the present invention provides an electric shaver having a floating support structure including a head body containing a motor and blades; a grip body configured to support the head body above the grip body and including an upper end adjacent the head body, wherein the head body accommodates the motor so that the motor is positioned above the upper end of the grip body; and the floating head support structure includes front and rear support walls extending upward from front and rear edges of the upper end of the grip body to enclose and pivotally support a lower portion of the head body in a forward/rearward direction. Further, spring articulation elements may be provided between the head body and an upper surface in the grip body; and may support vertical floating movement of head support brackets, the support brackets being pivotably joined to the head body within guide slots formed on the inner surfaces of the front and rear support walls, and energizing springs that press upward against the head support brackets. Further, the head support brackets may be attached to the head body at multiple points along a width direction. The electric shaver having a floating head support structure may include pieces of an elastic material positioned in the upper end of the guide slots that guide the movement of the head support brackets. Further, the grip body may include front and rear support walls that extend upward beyond an upper surface in the grip body from front and rear housings, respectively.

According to a further aspect of the present invention, a head case extension portion extends downward from a central region of the lower surface of the head body. Further, the head case extension portion may be located between and covered by the front and rear support walls. The width of the front and rear support walls may be narrower than the width of the grip body. Further, one of the front and rear support walls may support the head body in the forward/rearward direction. In a further aspect of the present invention, a finger extending from the lower rear surface of the head body slides against either the front or rear support wall to prevent inclination of the head body in the forward/rearward direction. Further, a waterproof structure is defined between the head body and an upper surface in the grip body, an elastic tube connects the head body and grip body, and wires running through the elastic tube are provided to supply electrical power from the grip body to the head body. Further, a non-slip elastomeric part may be provided on at least a front surface of the grip body.

A further aspect of the present invention provides an electric shaver having a floating head support structure, the electric shaver including a head portion containing a motor and blades; a grip portion that supports the head portion above the grip portion for movement in a lateral direction relative to the grip portion; and the floating head support structure comprises front and rear support walls extending from the grip portion toward the head portion, the front and rear support walls enclosing and supporting a lower portion of the head portion in a forward/rearward direction substantially transverse to the lateral direction. Further, the front and rear support walls may extend toward the head portion from front and rear housings, respectively. The floating head support structure may further include a head case extension portion extending from a central region of a lower surface of the head portion.

A further aspect of the present invention provides an electric shaver having a floating support structure including a head body containing a motor and blades; and a grip body configured to support the head body for movement relative to the grip body; wherein the head body is configured to accommodate the motor so that the motor is positioned outside of the grip body.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe an embodiment of the electric shaver head support structure of the present invention with reference to the attached drawings.

Figure 1:
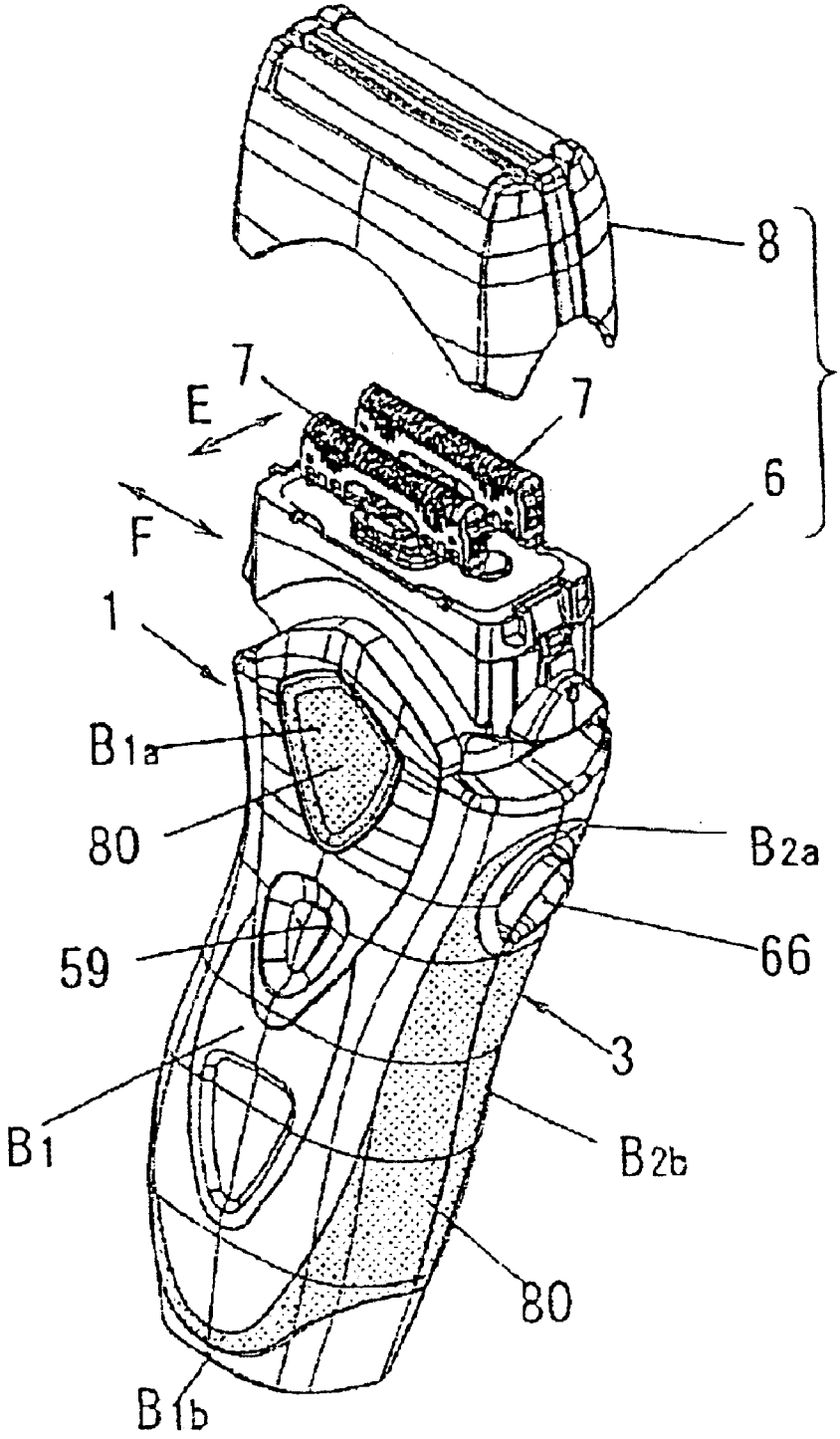
FIG. 1 is a perspective view of an electric shaver according to an embodiment of the present invention.
Figure 2:
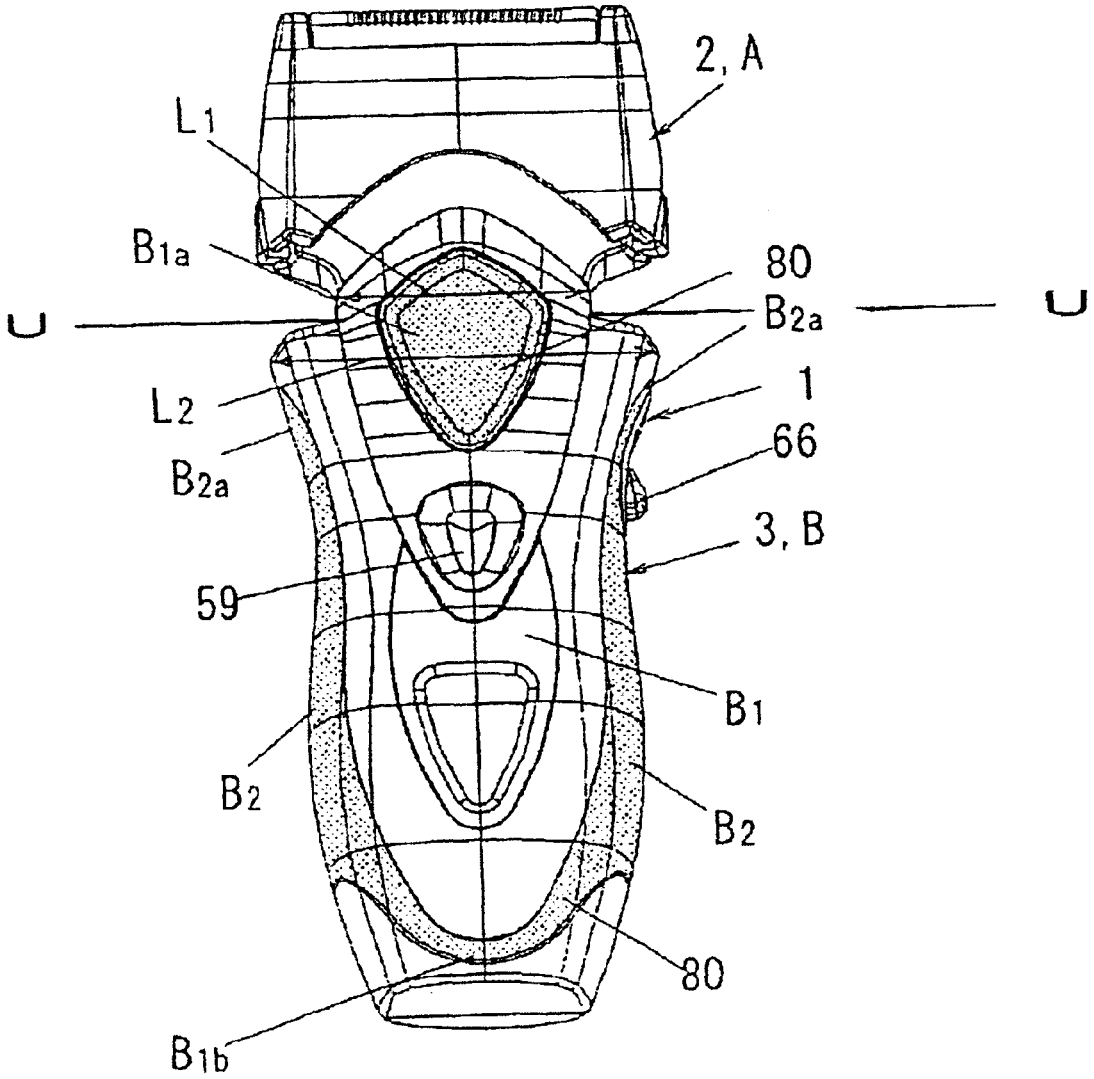
FIG. 2 is a front view of the electric shaver of the embodiment of FIG. 1.
Figure 6:
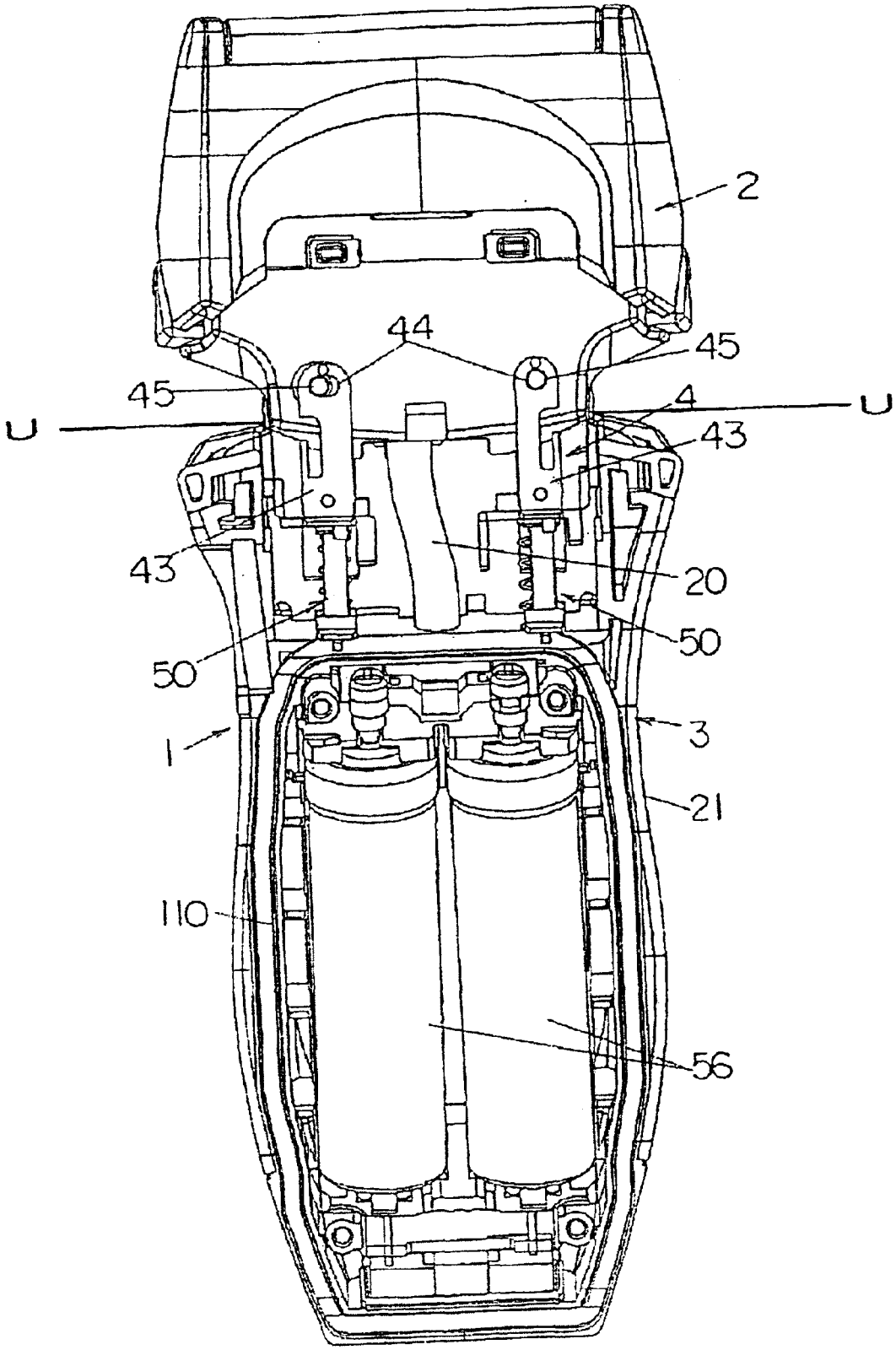
FIG. 6 is rear view of the electric shaver of the embodiment of FIG. 1 with the rear housing removed.

The electric shaver 1 of the present invention is illustrated in FIG. 1. The electric shaver 1 includes two separate components including a head body 2 and a grip body 3. A support mechanism located at the upper end of the grip body 3 supports the head body 2. FIGS. 2 and 6 illustrate the upper end of the grip body 3 defined by a line U. As illustrated in FIG. 6, a head support block 4 is located between the head body 2 and the grip body 3.

Figure 3:
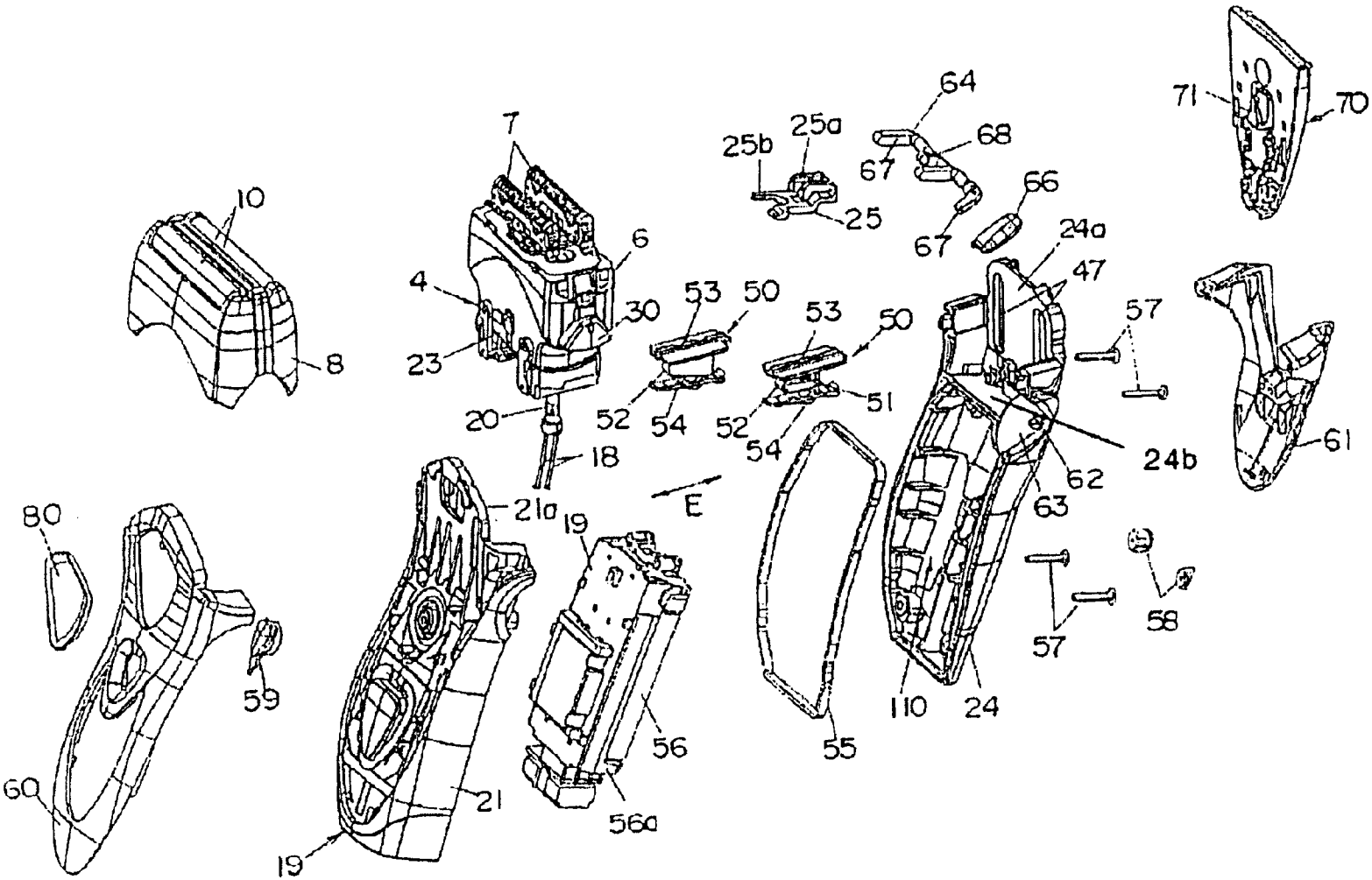
FIG. 3 is an exploded perspective view of the electric shaver of the embodiment of FIG. 1.
Figure 4:
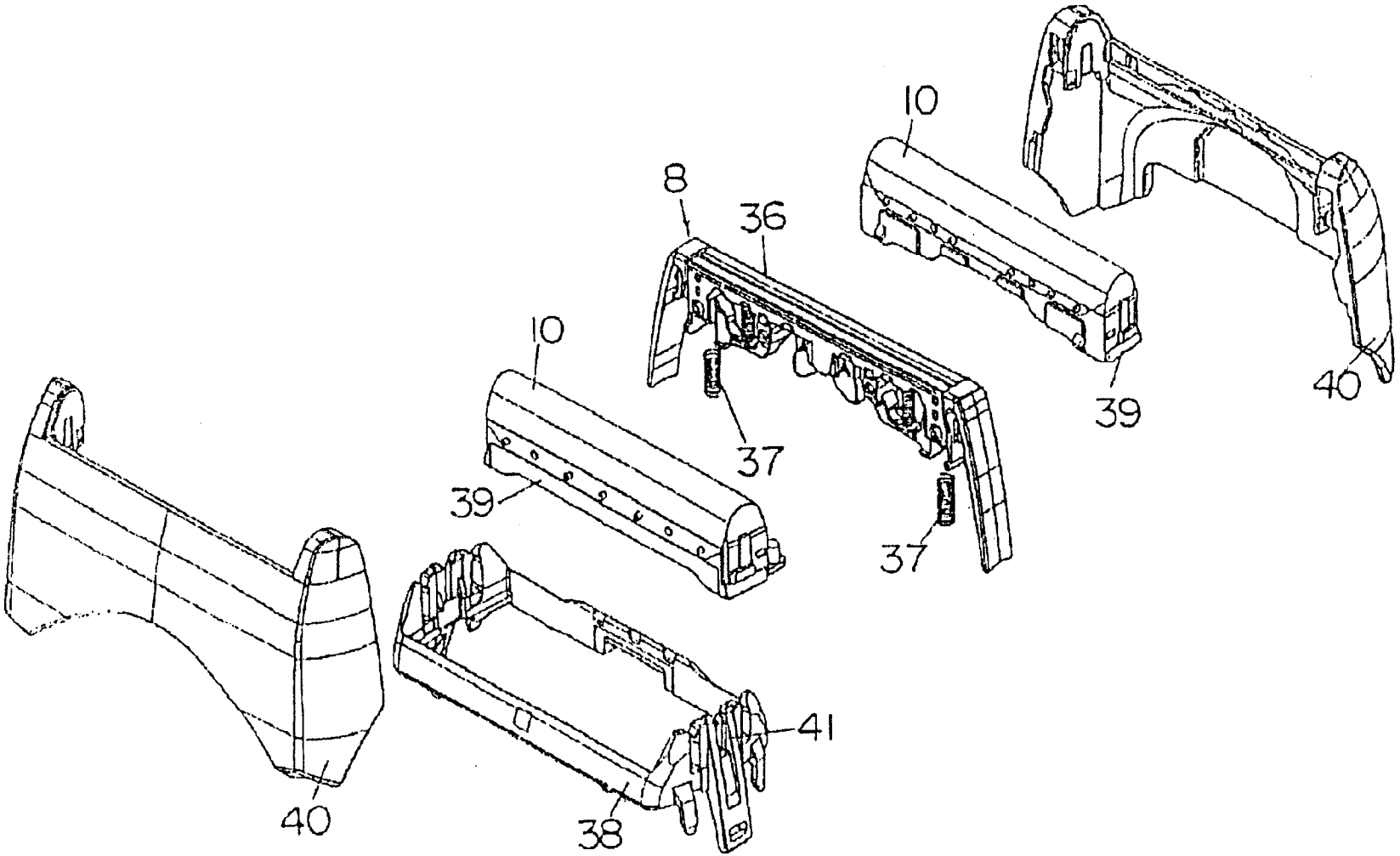
FIG. 4 is an exploded perspective view of the blade block of the embodiment of FIG. 1.
Figure 5:
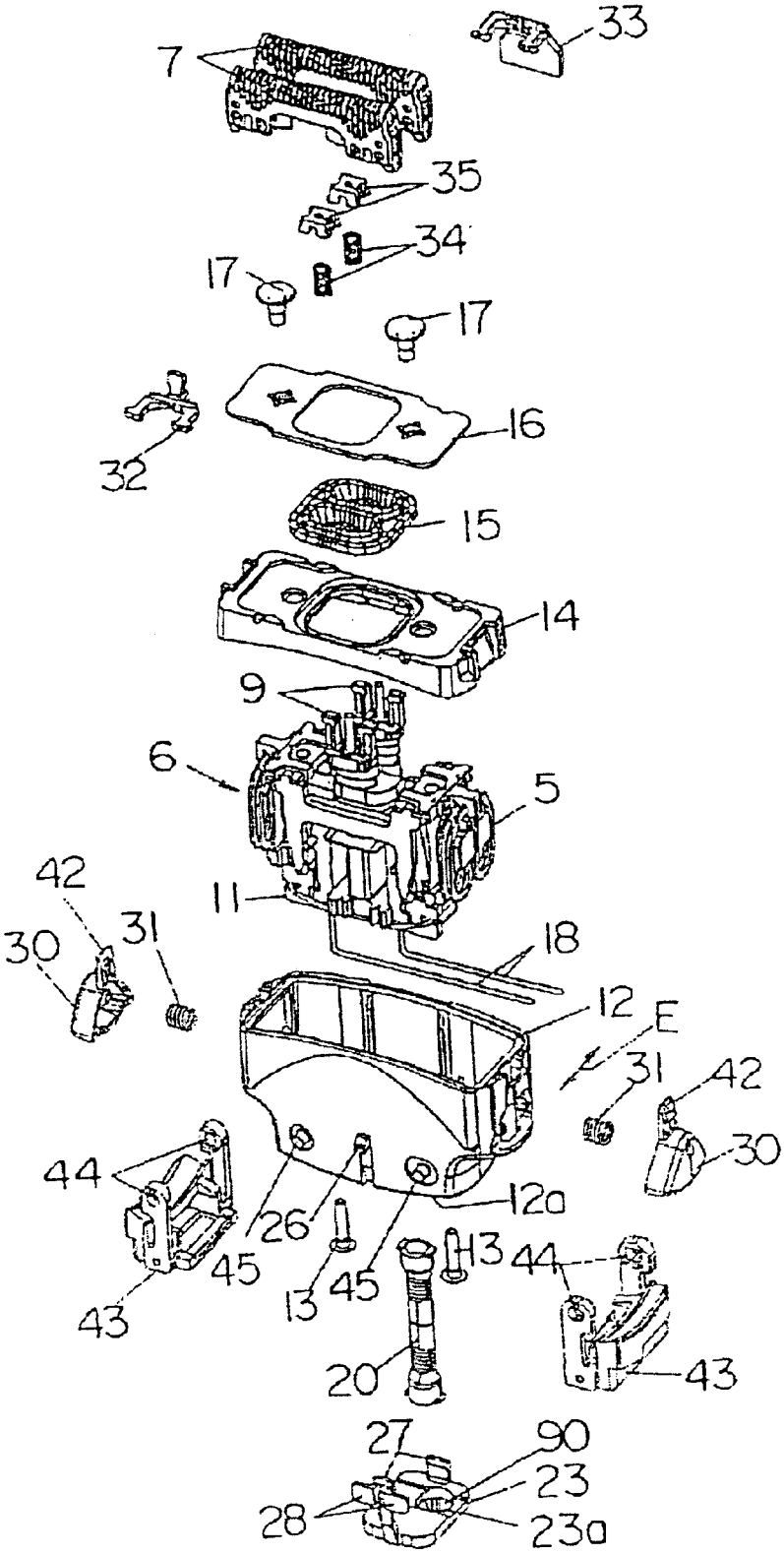
FIG. 5 is an exploded perspective view of the head body of the embodiment of FIG. 1.

The following describes the structure of the head body 2 with reference to FIGS. 3 through 5.

The head body 2 includes a power block 6 which houses a linear motor 5, inner blades 7, and an outer blade block 8. The lateral oscillating movement (in direction 'F' shown in FIG. 1) generated by the linear motor 5 is transferred to the inner blade 7 through a power link 9 which is provided at the top of linear motor 5. Blades of hair entering the orifices of outer blades 10 are severed by the oscillating movement of inner blades 7 against outer blades 10. As illustrated in FIG. 5, linear motor 5, which is a single integrated structure that includes motor base 11, extends downward into head case 12, and is fixedly joined thereto with bottom screw 13.

Figure 7:
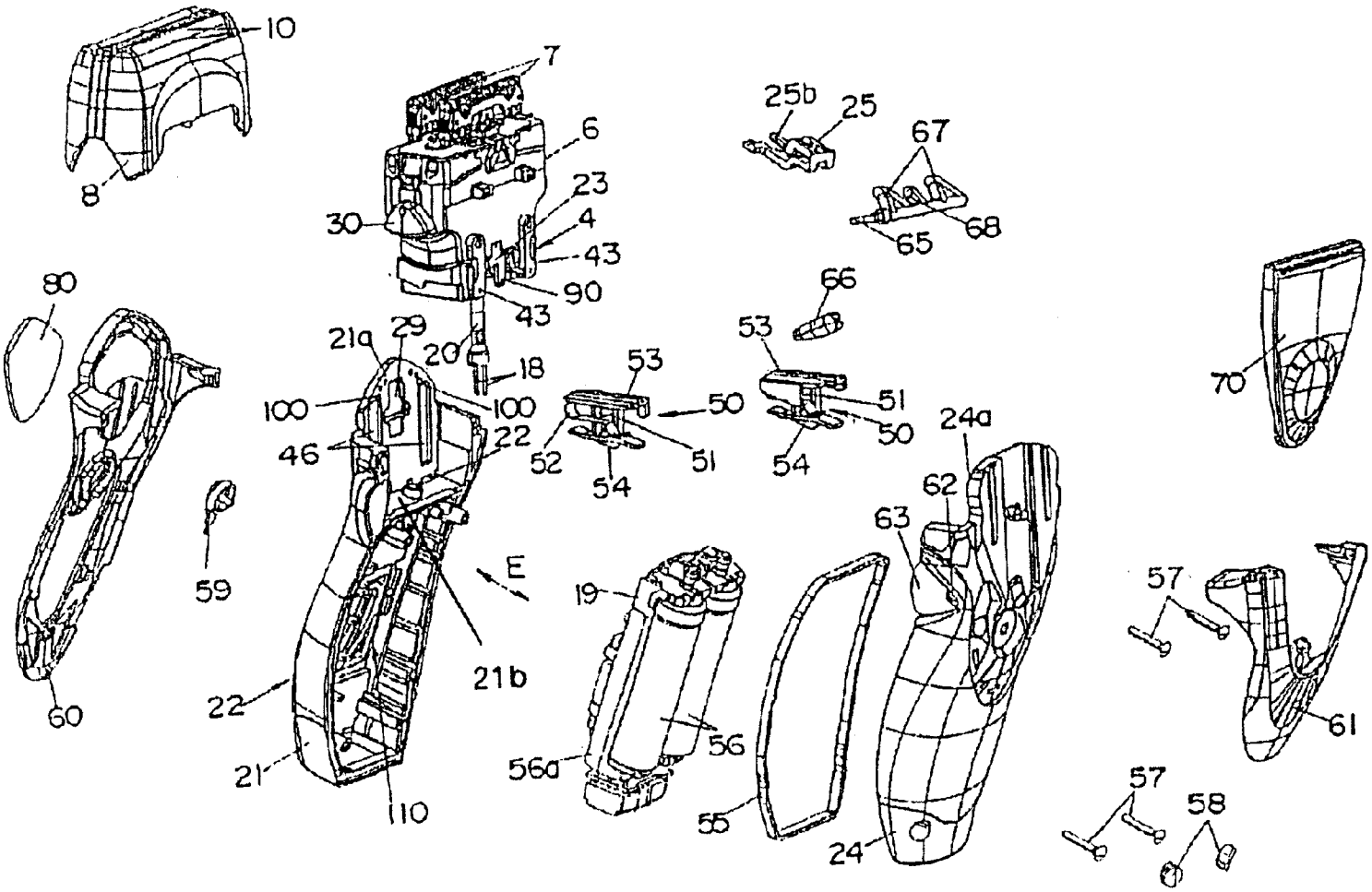
FIG. 7 is an exploded perspective view of the electric shaver of the embodiment of FIG. 1.

As illustrated in FIG. 5, head case cover 14, rubber sealing gasket 15, and gasket cover 16 are respectively secured to the upper side of head case 12 with top screws 17. Head case 12, thus assembled and secured by the top and bottom screws, forms power block 6 which is a box-like structure that contains linear motor 5. A rubber gasket (not shown) is installed at the underside of head case cover 14, thus waterproofing power block 6. The ends of wires 18, which extend from the bottom of linear motor 5 as shown in FIG. 3, are connected to the drive circuit installed within grip body 3 to supply power to linear motor 5. After passing through an orifice (not shown) in the bottom of head case 12 where elastic tube 20 seals the passage of wires 18 into the head case, wires 18 continue through orifice 22 (FIG. 7) on the upper surface of front housing 21 (to be described subsequently), and connect to circuit 19 (shown in FIG. 3) which is housed between front and rear housings 21 and 24. The upper end of elastic tube 20 is inserted into a cylindrical orifice (not shown) on the bottom of head case 12, and further is inserted into stop orifice 23*a* of head stop member 23 (FIG. 5), which will be subsequently described, to anchor the portion of wires 18 extending out of head case 12. The upper surface 21*b* (FIG. 7) of front housing 21 and the upper surface 24*b* (FIG. 3) of rear housing 24 together define an upper surface in the grip portion 3. The lower end of elastic tube 20 is inserted into orifice 22 located on the upper surface 21*b* of front housing 21, and then passes through cutout 25*b* of recessed bracket 25 (FIG. 7). In other words, a waterproof structure is formed between head body 2 and space 110 in grip body 3, wires 18 pass through the waterproof structure within elastic tube 20 connecting head body 2 and grip body 3, and electrical power is supplied from grip body 3 to head body 2, thus forming a waterproof connecting structure that is easy to clean, and that allows a wide range of movement between head body 2 and grip body 3.

As shown in FIG. 5, head case extension 12*a* extends downward from the central region of the lower part of head case 12. Protruding shafts formed on head case extension 12*a* serve as points on which head body 2 is pivotably supported. Both ends of the lower surface of head case extension 12*a* extend upward to provide clearance that allows head body 2 to be able to undergo a large angle of incline in the lateral direction, and thus increase the ability of head body 2 to follow the contours of the skin being shaved. Furthermore, the downwardly extending part of head case extension 12*a* is the only part covered by front and rear support walls 21*a* and 24*a*. Because gaps are provided at both the front and rear surfaces of extension 12*a* in the fore-aft or forward/rearward direction E, head body 2 is able to pivot freely in the lateral (right-left) direction in a structure that inhibits the accumulation of shaved hair. Furthermore, as can be seen in FIG. 2, dimension L1, which is the width of front and rear support walls 21*a* and 24*a*, is narrower than dimension L2 which is the width of grip body 3 in the lateral direction F. This dimensional difference forms a contour on grip body 3 that prevents the user's fingers, which hold grip body 3 during shaving, from entering the space within which head body 2 pivots, thus preventing the user's fingers from interfering with the movement of head body 2 and increasing the security with which the electric shaver is held in the hand of the user.

The following will describe the mechanism that supports head body 2 while preventing play in the movement of head body 2 in the forward/rearward direction E. A structure is provided at front support wall 21*a* to maintain head body 2 in the forward/rearward direction E. As shown in FIG. 5, head stop member 23 is attached to power block 6. A pair of stop tabs 27, one each formed on the front and rear side of head stop member 23, limit the movement of nubs 26 which project from the front and rear surfaces of head case 12. A pair of tabs 28, which extend in both left and right directions from the front of head stop member 23, are inserted into latch orifice 29 located on front support wall 21*a* of front housing 21, thus forming a support structure that prevents power block 6 from moving in the forward/rearward direction E in relation to front housing 21 (FIG. 1). Therefore, regardless of any inclination of the space between front and rear support walls 21*a* and 24*a*, free play of power block 6 in the forward/rearward direction E is prevented by the support mechanism of front support wall 21*a*. Moreover, as shown in FIG. 7, finger 90, which extends downward from the lower surface of head stop member 23, slides against the inner surface of rear support wall 24*a* to guide power block 6 in the vertical direction while preventing inclination in the forward/rearward direction E as a result of the pressure applied when shaving. In other words, the floating movement of power block 6 is supported in the vertical direction, without any inclination of power block 6 in the forward/rearward direction E, through the pressure applied by finger 90 sliding on the inner surface of rear support wall 24*a*. This mechanism thus eliminates the poor shaving performance that can result from head body 2 inclining excessively in the forward/rearward direction E as a result of the friction generated by shaving.

As illustrated in FIG. 5, blade brackets 30 are provided at both lengthwise end surfaces of head case 12, and are mounted by blade bracket springs 31 which pressurize blade brackets 30 outward from within head case 12.

The following describes inner blades 7. As shown in FIG. 5, linear motor power link 9 extends through an orifice formed in the center of the upper surface of head case 12. Slit drive member 32 and trimmer drive rod 33 are joined to the forward and rearward sides, respectively, of power link 9. Inner blade support springs 34 are secured to the center of power link 9 by spring stoppers 35, and inner blades 7 are attached to and upwardly supported by spring stoppers 35.

The following will describe outer blade block 8. As shown in FIG. 4, a first mesh-type outer blade 10, slit blade 36, and second mesh-type outer blade 10 are arranged sequentially in the forward/rearward direction E, and are independently supported by rectangular support frame 38 through floater springs 37 which allow the blades to float. Each outer blade 10 is fixedly attached to an outer blade frame 39, and each outer frame 39 is joined to support frame 38 through a blade cover 40. Outer blade block 8 is removably connected to and supported by head case 12 through connector tabs 42 (FIG. 5), which extend upward from each blade bracket 30, extending into lock slots 41 which are provided on each end of support frame 38 in the lateral (F) direction.

The following will describe the structure of head support block 4 with reference to FIGS. 3, 5, and 6. Support bracket 43, as shown in FIG. 5, is an approximate "C" shaped member incorporating two projecting arms at the ends of which orifices 44 are formed. Two pivot pins 45 (four in total) are formed on the forward and rear wall of head case 12, and extend outward in the forward/rearward direction E. Each support pin on the front surface of head case 12 is aligned on the same axis with the corresponding support pin on the rear surface.

Two head support brackets 43 are provided. One head support bracket 43 pivotably connects to each end of head case 12 by orifices 44 pivot pins 45 inserted therein, thus forming a connective structure in which head support brackets 43 support head case 12 from below through connecting points on the front and rear surfaces of head case 12. Furthermore, as shown in FIG. 3, support brackets 43 are able to freely float in the vertical direction between front and rear support walls 21*a* and 24*a*, which extend upward from front and rear housing 21 and 24, within pairs of vertical guide slots 46 and 47 which are formed on the front and rear support walls, respectively.

The following will describe the operation of the device made possible by locating head support brackets 43 along the width direction of head case 12. In the case in which head body 2 is pressed against the skin at an angle differing from that of the plane of the skin surface, both ends of head body will come into contact with the skin while the force generated from that contact presses head body downward. Because support brackets 43 establish points on which the sides of head body 2 in contact and not in contact with the skin are able to pivot, pressure is applied to the side of head body 2 farthest from the skin contact point pivots. As it takes only a small amount of force to pivot head body 2, head body 2 is able to easily pivot to an attitude that maintains the blades in close contact with the skin, and thus improve the shaving performance of the electric shaver 1.

In the embodiment of the present invention, flexible elastomeric elements or components 100 (shown in FIG. 7) are provided at the upper end of guide slots 46 in front support wall 21*a*. Elastomeric elements 100 are able to absorb the shock of brackets 43 returning to the upper travel limit of guide slot 46, thus insulating the hand holding the electric shaver from shock and reducing the noise generated by the electric shaver.

The following will describe spring blocks 50 which control the attitude of head support brackets 43. As illustrated in FIGS. 3 and 7, two spring blocks 50 are provided at locations opposing each head support bracket 43. Each spring block 50 incorporates coil spring 51 and plate spring 52 which are sandwiched between the top and bottom parts of spring holder 53. Coil spring 51 is located by means of projecting nubs (not shown in the drawings) formed on the top and bottom parts of spring holder 53. Plate spring 52 is an approximately U-shaped spring of which one end is welded to a projecting portion on the upper part of spring holder 53. Spring block 50 is formed by the upper hooked part of two projecting members (not shown in the drawings), which extend from spring holder 53 at either side of coil spring 51, inserted into and joined to orifices (not shown in the drawings) in the upper side of spring holder 53. Head support brackets 43 are supported from below by spring blocks 50 through the upper side of spring holder 53 contacting the lower surface of head support bracket 43, and the lower side of spring holder 53 contacting the lower surface of space 110 between front and rear housings 21 and 24. This structure can be waterproofed, is easy to clean, and allows a wide range of relative movement for power block 6. Furthermore, the use of a spring articulation element, which is formed by head support brackets 43 and spring blocks 50, located above space 110 between head body 2 and grip body 3, negates the necessity of enlarging grip body 3, thus allowing grip body 3 to be made in a shape that is comfortable to hold. Moreover, the undersurface of head body 2 can be supported throughout its entire depth to stabilize the movement of head body 2. Also, as head support brackets 43, which form a freely pivotable joint with head body 2, are able to slide vertically within guide slots 46 and 47 formed on front and rear housing inner walls 21*a* and

24*a,* and as head support brackets 43 are supported by spring pressure through spring blocks 50, a structure is provided that allows head body 2 to both laterally pivot and vertically telescope.

The following will describe the mechanism through which the spring pressure of spring block 50 is adjusted. As shown in FIG. 3, fan-shaped surface 63 and orifice 62 are provided at the upper region of one side of rear housing 24. Lever shaft 64 is pivotably installed within orifice 62. Manual adjustment lever 66 is joined to stub shaft 65, which extends from the end of lever shaft 64, at surface 63 of rear housing 24. Fingers 67, which extend radially from lever shaft 64, project into the internal part of spring blocks 50. Lever shaft 64 extends into spring block 50, where the manually pivoted movement of adjustment lever 66 rotates lever shaft 64 to change the height of the ends of fingers 67, thus expanding or compressing spring block 50. This mechanism is able to change the height of the lower surface of spring holder 53 and plate spring 52, and is thus able to adjust the extent of vertical float of the head body 2 and the amount of pressure applied against the floating movement. Moreover, arm 68, on the end of which is formed a spherical member, extends radially outward from the approximate axial center of lever shaft 64 to connect to slot 25*a* of indent bracket 25, which connects to lever shaft 64, thus forming a mechanism able to mechanically index the position of lever shaft 64 through tactile indentations.

The following will describe grip body 3 with reference to FIGS. 1, 2, 3, and 6. Grip body 3 is comprised of the center portion of mutually assembled front and rear housings 21 and 24. Rubber gasket 55 (FIGS. 3 & 7) is located between the joined surfaces of front and rear housings 21 and 24 that form waterproof space 110. A shaving head support structure is formed from the inner surfaces of front and rear support walls 21*a* and 24*a* extending upward from space 110. As shown in FIG. 3, support block 56*a,* which houses batteries 56 and circuit 19, and other components, is provided within space 110. Front and rear housings 21 and 24 are fixedly joined through the use of screws 57 which are inserted from the rear of the housing. As shown in FIG. 3, screw covers 58 are used to cover screws 57.

Front panel 60, to which switch 59 is installed therein, is attached to the forward facing surface of front housing 21 through hook parts formed thereon. Rear panel 61 attaches to the rearward facing surface of rear housing 24.

Trimmer block 70, as illustrated in FIGS. 2, 3, and 7, slides vertically on rear panel 61. Trimmer drive link 71 (FIG. 3) connects to trimmer drive rod 33 on head body 2 when trimmer block 70 is moved to the upper limit of vertical travel.

Head body 2 is firmly maintained in position against pressure applied in the forward/rearward direction E as a result of the support provided by front and rear support walls 21*a* and 24*a* which extend downward to become front and rear housings 21 and 24 that define space 110 within grip body 3. Because head body 2 and the upper surface of space 110 in grip body 3 are mutually independent structures, head body 2 can be made as a dustproof and waterproof component capable of wide ranging movement that allows the cutting blades to more closely follow the contours of the skin when shaving. Moreover, as head body 2 is supported in the forward/rearward direction E by front and rear support walls 21*a* and 24*a* of grip body 3, the shaver can be gripped with the user's fingers pressing against front and rear support walls 21*a* and 24*a* without the fingers interfering with the movement of head body 2.

Moreover, because in the present invention the head support block is located between head body 2 and grip body 3, the head support block has no effect on the width of grip body 3, thus allowing grip body 3 to be formed to narrow contours that provide a comfortable hand grip for the user. The movement of head body 2 is supported by a highly stable mechanism made possible by the entire undersurface of head body 2 being supported in the forward/rearward direction E.

Furthermore, as space 110 is formed within grip body 3 beneath front and rear housings 21 and 24 from which front and rear support walls 21*a* and 24*a* upwardly extend, the head body 2 support structure and space 110 can be formed simultaneously upon assembly of the housings, thus providing for a more efficient assembly process. As a result of support walls 21*a* and 24*a* being respective integral parts of front and rear housings 21 and 24, a highly rigid head support structure is formed that provides the benefits of improved shaving performance and a reduced number of shaver components.

The tendency for the fingers gripping the shaver to enter the space in which the head body moves is significantly reduced as a result of width L1 (direction F in FIG. 1) of front and rear support walls 21*a* and 24*a* being narrower than width L2 of grip body 3. This dimensional difference creates a structure that largely prevents finger contact with head body 2 and improves the stability of the grip with which the shaver is held.

Figure 8A:
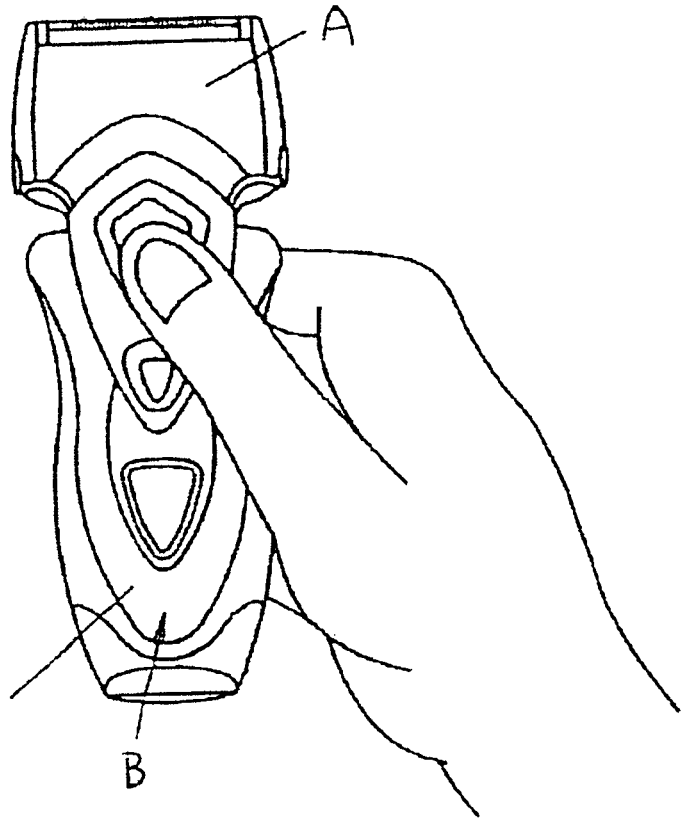
FIG. 8*a* is a front view of the electric shaver of the embodiment of FIG. 1 held between the thumb and fingers.
Figure 8B:
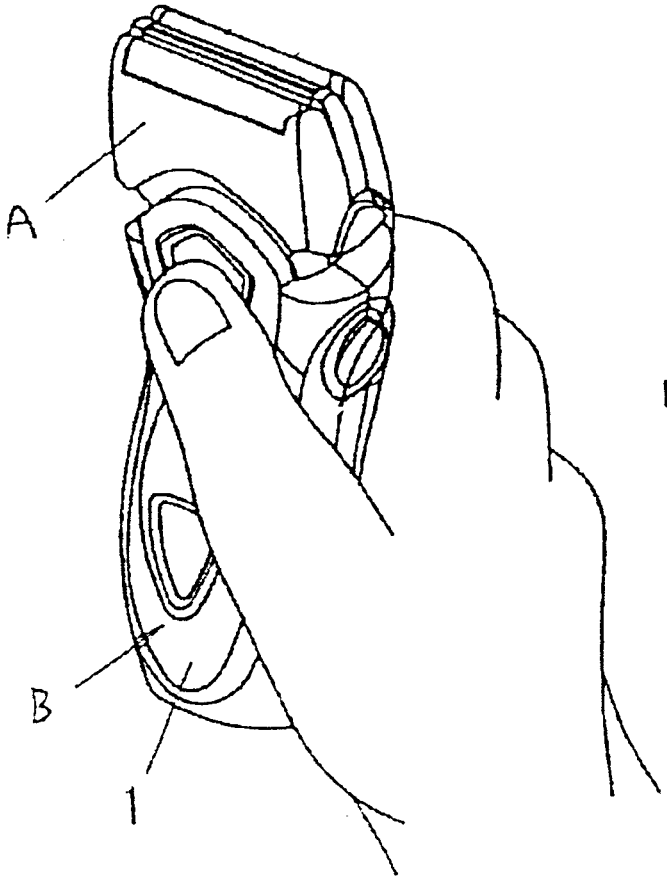
FIG. 8*b* is a perspective view of the electric shaver of the embodiment of FIG. 1 held between the thumb and fingers.
Figure 9A:
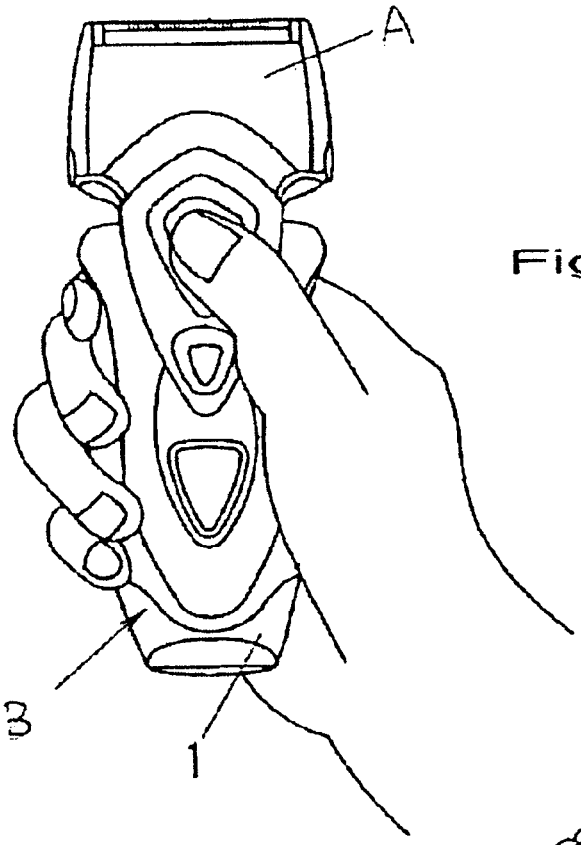
FIG. 9*a* is a front view of the electric shaver of the embodiment of FIG. 1 held by the thumb and fingers enclosing the shaver.
Figure 9B:
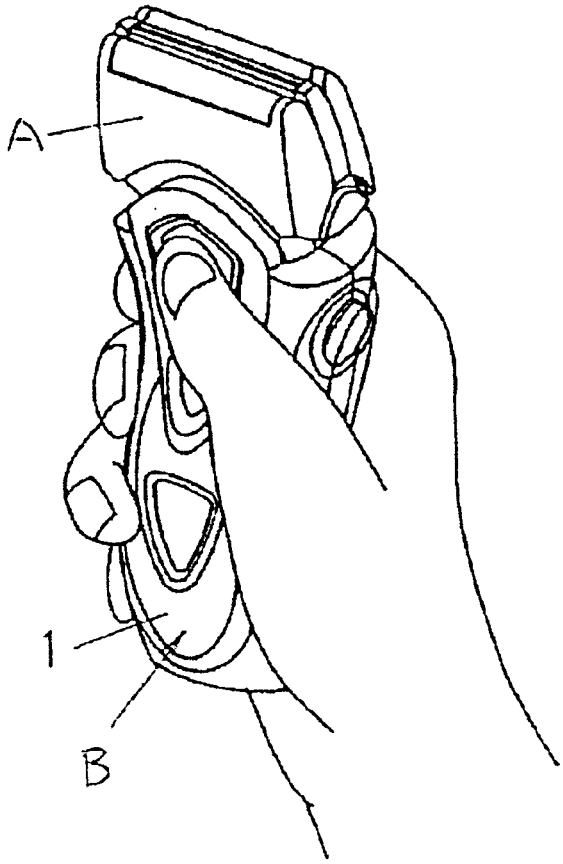
FIG. 9*b* is a perspective view of the electric shaver of the embodiment of FIG. 1 held by the thumb and fingers enclosing the shaver.

As indicated by the dotted areas in FIGS. 1 and 2, an elastomeric non-slip portion 80 is provided on front surface B1 of grip portion 3. Part 80, which may be constructed of any suitable material such as, for example, a flexible elastomer-like material with a large frictional coefficient, continuously covers the portion of grip body 3 extending from lateral surface B2 to the lower part of the rear surface of grip body 3, and is also installed on upper frontal surface B1*a* of grip body 3. The portion of non-slip part 80 on lateral surface B2 extends to upper lateral surface B2*a* and lower frontal surface B1*b,* thus forming a non-slip surface that encompasses grip body 3. As shown by the squeeze-type shaver holding methods illustrated in FIGS. 8*a* and 8*b,* and the enveloping-type methods illustrated in FIGS. 9*a* and 9*b,* the palm and inner surfaces of at least two fingers among the middle, ring, and little fingers will be in contact with non-slip part 80, regardless of the size of the hand gripping the shaver or small changes in the gripping position of the hand, thus increasing the security of the grip applied to the front and rear surfaces of the shaver. Because non-skid part 80 is also applied to upper frontal surface B1*a* of grip body 3, which is the location where the thumb is normally placed with the fingers grasping grip body 3, the shaver can be held in a very stable and comfortable manner by the hand of the user.

The present invention includes an electric shaver including a grip body and a head body whereby the head body, in which a motor and cutting blades are provided, is movably supported by the grip body. A box-like space is formed within the grip body below the lower surface of the head body, and front and rear support walls, which extend upward beyond the box-like space, cover the front and rear surfaces of the head body, thus forming a structure that firmly supports the head in the forward/rearward direction, that allows the user's fingers to grip the front and rear support walls while shaving, and that prevents the user's fingers from coming into contact and interfering with the movement of the movable head body. The head body is thus able to traverse through a wide range of movement and therefore better follow the contours of the skin when shaving, regardless of the attitude of the shaver when held against the skin. Moreover, because the box-like space within the grip body is structured independently from the head body, the box-like space can be effectively sealed to prevent the incursion of debris and water.

The present invention further provides spring articulation elements installed between the head and the portion of the grip body located at the upper surface of the box-like space, thereby negating the necessity of increasing the size of the grip body, and thus allowing the grip body to be shaped to a thin and comfortably holdable contour. The spring articulation elements also provide a well controlled vertically floating action to the head body.

The present invention includes a mechanism whereby the spring articulation elements support the vertically floating movement of the head support brackets along guide slots formed on the inner surfaces of the front and rear support walls of the grip body, and energize springs that press upward against the head support brackets, thus assuring a smooth pivoting and vertically floating movement of the head body.

The present invention provides a structure through which the head support brackets attach to the head body at multiple points in the width direction, thus forming a mechanism whereby, when one end of the head contacts the skin, the support bracket at the other end of the head becomes a pivot point on which that end of the head is able to largely incline in the lateral direction to more closely follow the contours of the skin.

The present invention also includes flexible elastomer pieces positioned in the upper end of the guide slots that guide the movement of the head support brackets. The elastomer pieces absorb the shock of the support brackets returning to the upper travel limit of the guide slots, insulate the user's hand from shock, and reduce noise.

The grip body is constructed from front and rear housings that define a box-like space there between, and front and rear support walls extending upward from the front and rear housings, thereby creating a structure in which the head support body and box-like space in the grip body are formed simultaneously. As a result, the shaver becomes easier to assemble, the support walls provide a highly rigid head support structure, shaving performance is improved, and the number of shaver components is reduced.

The present invention also provides a head case extension that extends downward at the center of the lower surface thereon to form an axis of support for the head body. The outer ends of the lower surface of the head case extension project upward to provide clearance that allows the head to laterally incline to a large degree to better follow the contours of the skin.

The head case extension is provided between and covered by the front and rear support walls that extend upward from the grip body, thus providing for a firmly supported head pivoting movement and a structure resistant to the accumulation of hair.

The present invention also provides for a structure in which the width of the front and rear support walls is smaller than the width of the grip body, thus largely preventing the user's fingers from entering the region in which the head body is able to move and interfere with the movement of the head body, and increasing the security of the grip.

The present invention also provides for a structure that prevents free play of the head body, regardless of any inclination of the space between the front and rear support walls, through a mechanism that supports the head body at either the front or rear support wall.

The present invention also provides a finger that extends from the lower rear surface of the head body and slides against either the front or rear support wall in order to prevent forward/rearward inclination of the head body, thus preventing a decline in shaving performance that can result from the head body inclining in response to pressure applied thereto in the forward/rearward direction when shaving.

The present invention provides a waterproof structure between the head body and box-like space in the grip body wherein an elastic tube connects the head body and grip body, and wherein wires run through the elastic tube to provide electrical power to the head body from the grip body, thus forming a structure that allows for a large degree of movement between the head body and grip body, forms a waterproof electrical connection there between, and allows the shaver to be easily cleaned.

Further, the present invention provides a non-slip elastomeric body on at least the front surface of the grip body, thereby affording a more secure grip on the electric shaver, when the user's thumb is normally placed on the elastomeric body with fingers gripping the grip body, and thus increasing the security with which the shaver can be held. As a result, the electric shaver can be gripped more securely and is largely prevented from slipping out of the hand.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application Nos. 2002-176471, filed on Jun. 17, 2002, and 2002-316160, filed on Oct. 30, 2002, which are herein expressly incorporated by reference in their entirety.

What is claimed is:

1. An electric shaver having a floating head support structure comprising:

a head body containing a motor and blades;

a grip body configured to support said head body above said grip body and including an upper end adjacent said head body, wherein said head body accommodates said motor so that said motor is positioned above said upper end of the grip body; and said floating head support structure comprises front and rear support walls extending upward from front and rear edges of said upper end of said grip body to enclose and pivotally support a lower portion of said head body in a forward/rearward direction.

2. The electric shaver having a floating head support structure according claim 1, wherein spring articulation elements are provided between the head body and an upper surface in the grip body.

3. The electric shaver having a floating head support structure according to claim 2, wherein the spring articulation elements support vertical floating movement of head support brackets, said support brackets being pivotably joined to said head body within guide slots formed on the inner surfaces of the front and rear support walls, and energizing springs that press upward against the head support brackets.

4. The electric shaver having a floating head support structure according to claim 3, wherein the head support brackets are attached to the head body at multiple points along a width direction.

5. The electric shaver having a floating head support structure according to claim 3, wherein pieces of an elastic material are positioned in the upper end of the guide slots that guide the movement of the head support brackets.

6. The electric shaver having a floating head support structure according to claim 1, wherein the grip body includes front and rear support walls that extend upward beyond an upper surface in the grip body from front and rear housings, respectively.

7. The electric shaver having a floating head support structure according to claim 1, wherein a head case extension portion extends downward from a central region of the lower surface of the head body.

8. The electric shaver having a floating head support structure according to claim 7, wherein the head case extension portion is located between and is covered by the front and rear support walls.

9. The electric shaver having a floating head support structure according to claim 6, wherein the width of the front and rear support walls is narrower than the width of the grip body.

10. The electric shaver having a floating head support structure according to claim 6, wherein one of the front and rear support walls supports the head body in the forward/rearward direction.

11. The electric shaver having a floating head support structure according to claim 10, wherein a finger extending from the lower rear surface of the head body slides against either the front or rear support wall to prevent inclination of the head body in the forward/rearward direction.

12. The electric shaver having a floating head support structure according to claim 1, wherein a waterproof structure is defined between the head body and an upper surface in the grip body, an elastic tube connects the head body and grip body, and wires running through the elastic tube are provided to supply electrical power from the grip body to the head body.

13. The electric shaver having a floating head support structure according to claim 6, wherein a non-slip elastomeric part is provided on at least a front surface of the grip body.

14. An electric shaver having a floating head support structure, said electric shaver comprising:

a head portion containing a motor and blades;

a grip portion that supports said head portion above said grip portion for movement in a lateral direction relative to said grip portion; and said floating head support structure comprises front and rear support walls extending from said grip portion toward said head portion, said front and rear support walls enclosing and supporting a lower portion of said head portion in a forward/rearward direction substantially transverse to the lateral direction.

15. The electric shaver having a floating head support structure according claim 14, said floating head support structure further comprising:

spring articulation elements positioned between said head portion and an upper surface in said grip portion.

16. The electric shaver having a floating head support structure according to claim 14, wherein said front and rear support walls extend toward said head portion from front and rear housings, respectively.

17. The electric shaver having a floating head support structure according to claim 14, said floating head support structure further comprising:

a head case extension portion extending from a central region of a lower surface of said head portion.

18. The electric shaver having a floating head support structure according to claim 14, said electric shaver further comprising:

a waterproof structure formed between said head portion and said grip portion;

an elastic tube connecting said head portion and said grip portion; and a plurality of wires extending through said elastic tube that are capable of supplying electrical power from said grip portion to said head portion.

19. An electric shaver having a floating support structure comprising:

a head body containing a motor and blades; and a grip body configured to support the head body for movement relative to the grip body;

wherein the head body is configured to accommodate the motor so that the motor is positioned outside of the grip body.

* * * * *